US009046824B2

(12) United States Patent
Inaba et al.

(10) Patent No.: US 9,046,824 B2
(45) Date of Patent: Jun. 2, 2015

(54) DEVELOPING DEVICE AND IMAGE FORMING APPARATUS

(71) Applicant: FUJI XEROX CO., LTD., Minato-ku, Tokyo (JP)

(72) Inventors: Shigeru Inaba, Kanagawa (JP); Shota Oba, Kanagawa (JP); Makoto Hirota, Kanagawa (JP); Yoshitaka Nakajima, Kanagawa (JP); Ryota Tomishi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/014,628

(22) Filed: Aug. 30, 2013

(65) Prior Publication Data

US 2014/0286681 A1 Sep. 25, 2014

(30) Foreign Application Priority Data

Mar. 25, 2013 (JP) ..... 2013-061951

(51) Int. Cl.
*G03G 15/09* (2006.01)

(52) U.S. Cl.
CPC ..... *G03G 15/0921* (2013.01)

(58) Field of Classification Search
CPC ..... G03G 15/0921; G03G 15/09; G03G 2215/0609
USPC ..... 399/275–277
See application file for complete search history.

(56) References Cited

U.S. PATENT DOCUMENTS

| | | | | | |
|---|---|---|---|---|---|
| 4,792,225 | A * | 12/1988 | Itaya | 399/223 |
| 4,895,105 | A * | 1/1990 | Kubo et al. | 399/275 |
| 5,036,364 | A * | 7/1991 | Murasawa | 399/236 |
| 5,465,138 | A * | 11/1995 | Jaskowiak et al. | 399/272 |
| 7,460,801 | B2 * | 12/2008 | Nishiyama | 399/44 |
| 2008/0131805 | A1 * | 6/2008 | Kawata et al. | 430/110.3 |
| 2013/0004209 | A1 * | 1/2013 | Kishida et al. | 399/277 |

FOREIGN PATENT DOCUMENTS

| | | | |
|---|---|---|---|
| JP | 06-130796 | A | 5/1994 |
| JP | 08-197353 | A | 8/1996 |
| JP | 09-211989 | A | 8/1997 |
| JP | 11-194617 | A | 7/1999 |

* cited by examiner

*Primary Examiner* — Rodney Bonnette
(74) *Attorney, Agent, or Firm* — Sughrue Mion, PLLC

(57) ABSTRACT

A developing device includes a sleeve and a magnet roller having first and second magnetic poles, the second magnetic pole being disposed downstream of the first magnetic pole. A magnetic attraction distribution on the sleeve in a region from the first magnetic pole to the second magnetic pole is such that the magnetic attraction decreases from a position of the first magnetic pole toward the downstream side, a gradient of change in the magnetic attraction decreases in a region downstream of a region in which a gradient of reduction in the magnetic attraction temporarily increases, thereby forming an attraction reduction region in which the magnetic attraction is reduced so that developer cannot be held on the sleeve, and the gradient of change in the magnetic attraction increases in a region downstream of the attraction reduction region so that the magnetic attraction increases to a position of the second magnetic pole.

7 Claims, 8 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2013-061951 filed Mar. 25, 2013.

BACKGROUND (i) Technical Field

The present invention relates to a developing device and an image forming apparatus.

(ii) Related Art

In image forming apparatuses that form a visual image by transferring toner onto an electrostatic latent image formed on an image carrier, a developing device is arranged so as to face the image carrier. The developing device includes a developing roller having a developer layer formed on a peripheral surface thereof, and the toner is transferred onto the image carrier from the developer layer.

Developing devices that use two-component developer containing toner and magnetic carrier often include a developing roller including a magnet roller that is supported in a fixed state in a non-rotatable manner and a cylindrical sleeve that is disposed around the magnet roller and supported in a rotatable manner. The magnet roller has plural magnetic poles arranged in a circumferential direction, and magnetically attracts the developer to a peripheral surface of the sleeve. The developer is transported in the circumferential direction by the rotation of the sleeve.

The developer that adheres to the sleeve passes through a region in which the sleeve faces the image carrier, and is used in the developing process. Then, the developer is removed from the peripheral surface of the sleeve, and new developer is supplied to the peripheral surface of the sleeve.

SUMMARY

According to an aspect of the invention, there is provided a developing device including a sleeve arranged so as to face an image carrier on which an electrostatic latent image is formed, the sleeve having a cylindrical shape and being rotated in a circumferential direction; and a magnet roller supported in a fixed state in the sleeve, the magnet roller having plural magnetic poles arranged in the circumferential direction and magnetically attracting developer containing a magnetic material so that the developer is held on a peripheral surface of the sleeve, the magnetic poles including a first magnetic pole and a second magnetic pole that is disposed adjacent to the first magnetic pole and downstream of the first magnetic pole in a rotation direction of the sleeve and that has a polarity opposite to a polarity of the first magnetic pole. A distribution of magnetic attraction applied to the developer on the peripheral surface of the sleeve in a region from the first magnetic pole to the second magnetic pole of the magnet roller is such that the magnetic attraction decreases from a position where the first magnetic pole is disposed toward the downstream side in the circumferential direction, a gradient of change in the magnetic attraction decreases in a region downstream of a region in which a gradient of reduction in the magnetic attraction temporarily increases, thereby forming an attraction reduction region in which the magnetic attraction is reduced so that the developer cannot be held on the peripheral surface of the sleeve, and the gradient of change in the magnetic attraction increases in a region downstream of the attraction reduction region so that the magnetic attraction increases to a position where the second magnetic pole is provided.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described with reference to the drawings.

Figure 1:
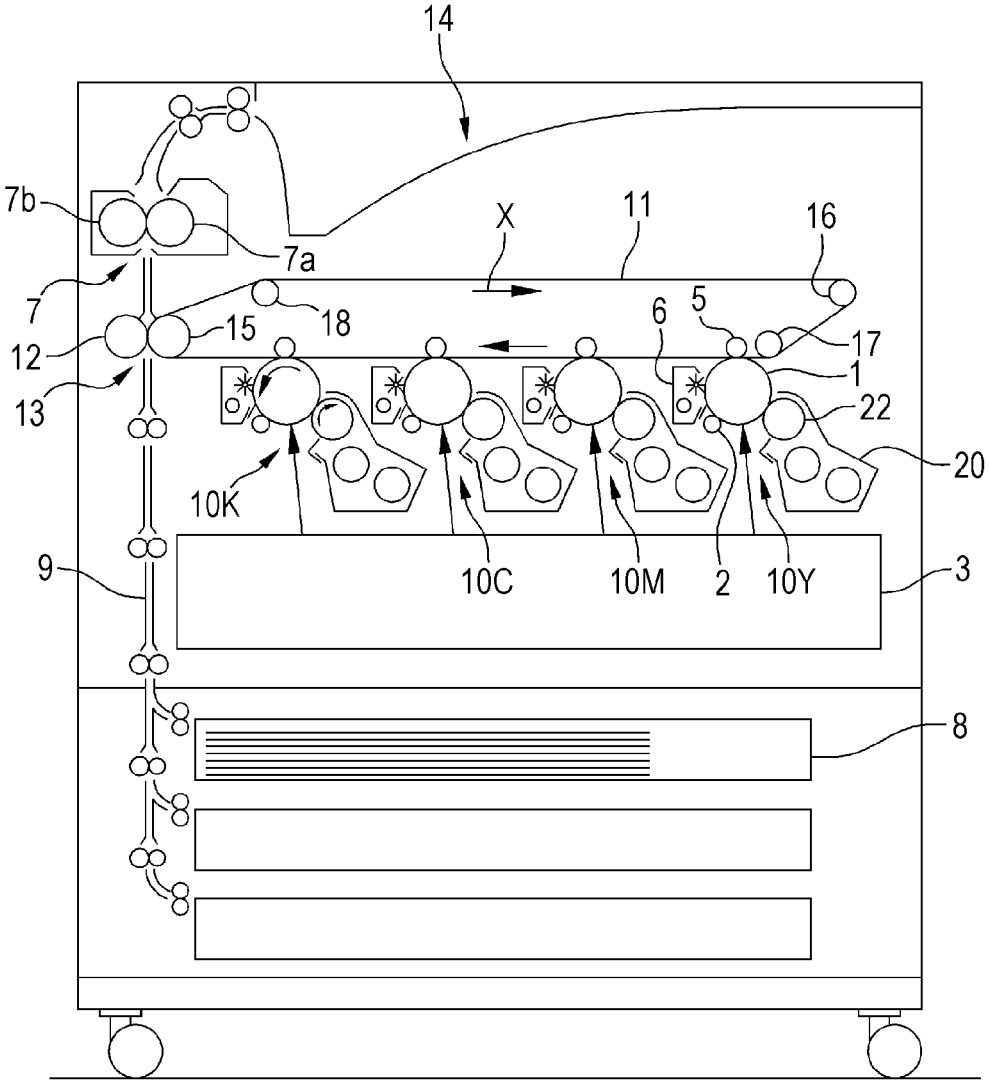
FIG. 1 is a schematic diagram illustrating an image forming apparatus according to an exemplary embodiment of the present invention.

FIG. 1 is a schematic diagram illustrating an image forming apparatus according to the exemplary embodiment of the present invention.

This image forming apparatus forms a color image by using toners of four colors, and includes electrophotographic image forming units 10Y, 10M, 10C, and 10K that respectively form yellow (Y), magenta (M), cyan (C), and black (K) images and an intermediate transfer belt 11 that faces the image forming units 10Y, 10M, 10C, and 10K.

The intermediate transfer belt 11 is an endless belt, and is wrapped around an opposing roller 15 that is rotated, an adjusting roller 16 that corrects displacement of the intermediate transfer belt 11 in a width direction, and two support rollers 17 and 18. The intermediate transfer belt 11 is arranged so as to face the image forming units 10Y, 10M, 10C, and 10K, and a peripheral surface thereof is rotated in the direction of arrow X shown in FIG. 1 when the opposing roller 15 is driven.

The image forming unit 10Y that forms a yellow toner image, the image forming unit 10M that forms a magenta toner image, the image forming unit 10C that forms a cyan toner image, and the image forming unit 10K that forms a black toner image are arranged in that order from an upstream position in a rotation direction of the intermediate transfer belt 11. A second transfer roller 12 used in a second transfer process is disposed downstream of the image forming unit 10K so as to be in contact with the intermediate transfer belt 11 and face the opposing roller 15.

A recording sheet, which is a recording medium, is transported from a recording sheet container 8 to a second transfer position 13, at which the second transfer roller 12 opposes the intermediate transfer belt 11, through a transport path 9. A fixing device 7 that fixes the toner images to the recording sheet by heating and pressing the toner images is disposed downstream of the second transfer position 13 along a transport passage of the recording sheet.

An output sheet holder 14 that holds recording sheets having toner images fixed thereto in a stacked manner is disposed downstream of the fixing device 7.

Each image forming unit 10 includes a photoconductor drum 1 on a surface of which an electrostatic latent image is formed and which functions as an image carrier. A charging device 2, a developing device 20, a first transfer roller 5, and a cleaning device 6 are arranged around the photoconductor drum 1. The charging device 2 charges the surface of the photoconductor drum 1. The developing device 20 forms a toner image by selectively transferring toner to a latent image formed on the photoconductor drum 1. The first transfer roller 5 transfers the toner image on the photoconductor drum 1 onto the intermediate transfer belt 11 in a first transfer process. The cleaning device 6 removes the toner that remains on the photoconductor drum 1 after the first transfer process. An exposure device 3 emits image light based on an image signal toward each of the photoconductor drums 1. Each photoconductor drum 1 is irradiated with the image light emitted from the exposure device 3, so that an electrostatic latent image is formed on the photoconductor drum 1 that has been charged.

The photoconductor drum 1 is obtained by forming a photosensitive layer on a conductive metal base material having an endless peripheral surface, and the peripheral surface thereof rotates. The metal base material is electrically grounded. The photosensitive layer is formed by successively stacking a charge generating layer and a charge transporting layer, which have different functions. When a portion of the photosensitive layer is irradiated with a laser beam emitted from the exposure device 3, a charge potential of the irradiated portion decreases.

The developing device 20 uses a two-component developer containing toner and magnetic carrier. The developing device 20 transfers the toner to the irradiated portion of the surface of the photoconductor drum 1 at a position where the developing device 20 faces the photoconductor drum 1, thereby forming a toner image as a visual image.

The cleaning device 6 is arranged so as to face the peripheral surface of the photoconductor drum 1, and includes a cleaning blade that is supported so as to contact the peripheral surface of the photoconductor drum 1. An edge portion at an end of the cleaning blade contacts the surface of the photoconductor drum 1 and scrapes off the toner and the like that remain on the photoconductor drum 1 after the first transfer process.

The second transfer roller 12 is pressed against the opposing roller 15 with the intermediate transfer belt 11 interposed therebetween, and is rotated by the rotation of the opposing roller 15. A second transfer voltage is applied between the second transfer roller 12 and the opposing roller 15, so that a transferring electric field is generated. Accordingly, when a recording sheet is inserted between the second transfer roller 12 and the intermediate transfer belt 11, the recording sheet is transported while being nipped between the second transfer roller 12 and the intermediate transfer belt 11, and the toner images on the intermediate transfer belt 11 are transferred onto the recording sheet by the electric field.

The fixing device 7 includes a heating roller 7*a* in which a heat source is disposed and a pressing roller 7*b* that is pressed against the heating roller 7*a*, and a nip section is formed between these rollers. The recording sheet onto which the toner images have been transferred is transported to the nip section, and is heated and pressed between the heating roller 7*a* and the pressing roller 7*b* that are rotated, so that the toner images are fixed to the recording sheet.

Figure 2:
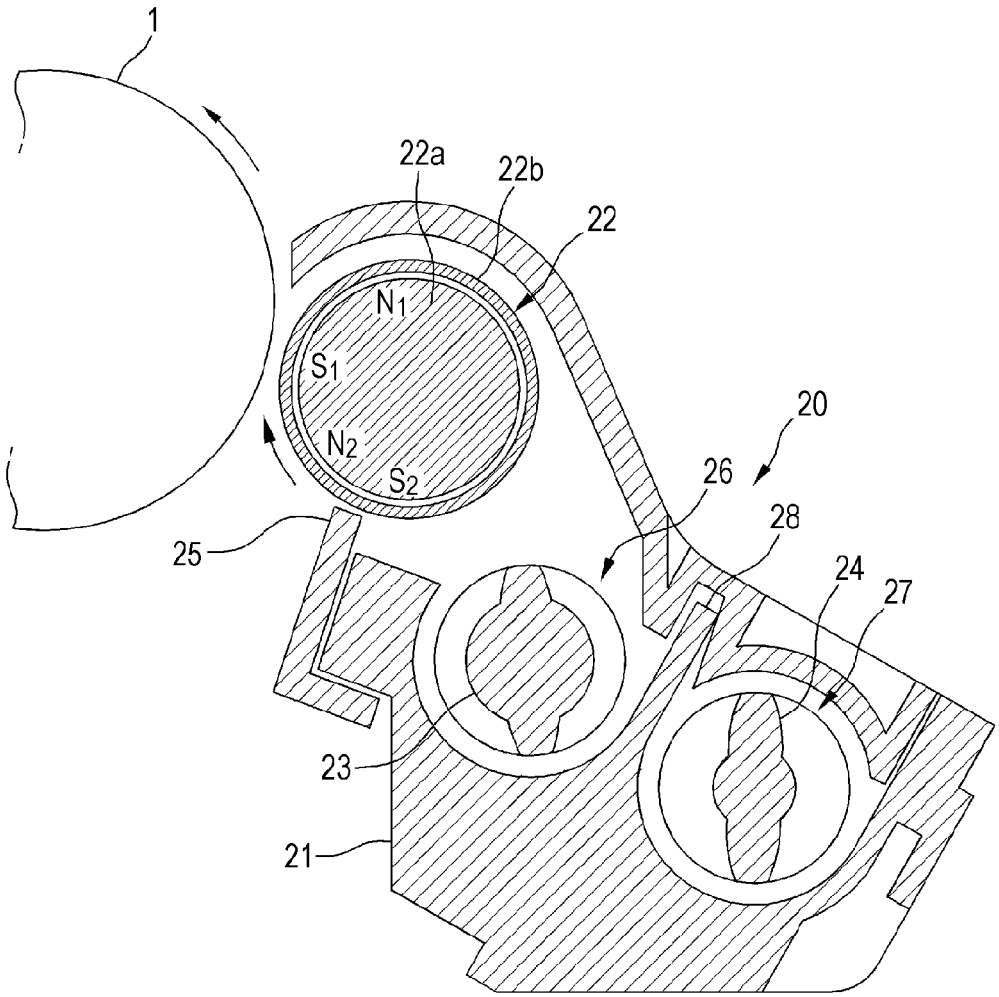
FIG. 2 is a schematic diagram illustrating a developing device according to the exemplary embodiment of the present invention that may be included in the image forming apparatus illustrated in FIG. 1.

FIG. 2 is a schematic sectional view of the above-described developing device 20.

The developing device 20 includes a housing 21 having developer chambers 26 and 27 that contain the two-component developer; a developing roller 22 that is disposed in the vicinity of the photoconductor drum 1 so as to face the photoconductor drum 1; first and second augers 23 and 24 that stir and transport the two-component developer in the developer chambers 26 and 27, respectively; and a layer thickness regulator 25 that regulates the amount of two-component developer that adheres to the developing roller 22.

The two-component developer contained in the housing 21 contains one of yellow, magenta, cyan, and black toners.

The housing 21 has an opening that opposes the photoconductor drum 1, and the developing roller 22 is disposed in the vicinity of the photoconductor drum 1 so as to face the photoconductor drum 1 in this opening.

The two-component developer contained in the housing 21 contains the toner, which contains a thermoplastic resin and a color material, and the magnetic carrier, which is obtained by coating particles formed by mixing a ferrite and a synthetic resin.

The toner may have a particle diameter of, for example, about 3 μm to 9 μm, and the magnetic carrier may have a volume mean particle diameter of, for example, 20 μm to 50 μm. The toner may be formed by a known method, such as a crushing and classifying method, a suspension polymerization method, a dissolving suspension method, or an emulsion aggregation method. The exemplary embodiment of the present invention is significantly effective when a toner that receives a small frictional force when rubbed against a surface of a sleeve, such as a toner formed by the suspension polymerization method, is used.

Each of the first and second augers 23 and 24 includes a support shaft and a helical blade provided around the support shaft, and is disposed so as to extend in the direction of the axis of the developing roller 22. The augers 23 and 24 rotate around the axes thereof to transport the two-component developer in the axial direction while stirring the two-component developer. The first and second augers 23 and 24 transport the two-component developer in the opposite directions. The developer chambers 26 and 27 are separated from each other by a partition wall 28 provided therebetween, and communicate with each other at both ends thereof. The two-component developer that is transported by the augers 23 and 24 is stirred in the developer chambers 26 and 27 and is circulated between the two developer chambers 26 and 27.

The developing roller 22 includes a magnet roller 22*a* that is supported in a fixed state and a sleeve 22*b*, which is a non-magnetic hollow cylindrical member that is rotatably supported around the magnet roller 22*a*. The two-component developer is magnetically attracted to the outer peripheral surface of the sleeve 22*b* by a magnetic field formed by plural magnetic poles provided in the magnet roller 22*a*, and is transported in the circumferential direction by the rotation of the sleeve 22*b*.

A power supply device (not shown) applies a developing bias voltage between the developing roller 22 and the photoconductor drum 1. Accordingly, an electric field is formed in a developing region in which the photoconductor drum 1 and the developing roller 22 face each other, and the toner, which is charged, is transferred onto an image portion of the photoconductor drum 1 in the electric field.

The layer thickness regulator 25 is disposed downstream, in the rotation direction of the developing roller 22, of the region in which the developer that has been stirred by the first auger 23 is supplied to the peripheral surface of the developing roller 22, and is spaced from the surface of the sleeve 22*b*. The layer thickness regulator 25 is made of a metal plate, and regulates the amount of developer that passes the layer thickness regulator 25 while being magnetically attracted to the sleeve 22*b*, so that an adjusted amount of two-component developer adheres to the sleeve 22*b*.

Figure 3A:
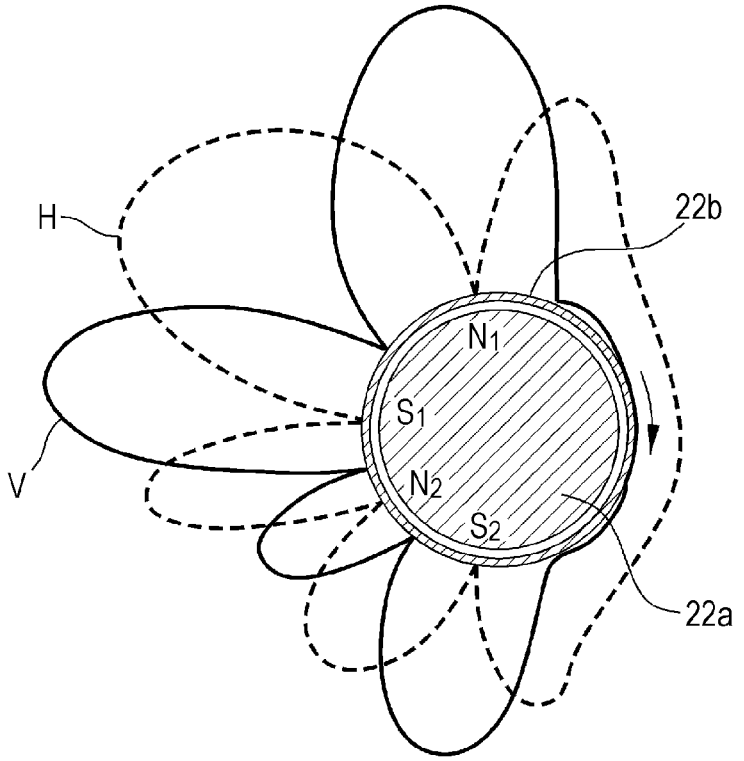
FIGS. 3A and 3B illustrate the magnetic flux density distribution and the magnetic attraction distribution, respectively, on a peripheral surface of a developing roller included in the developing device illustrated in FIG. 2.
Figure 3B:
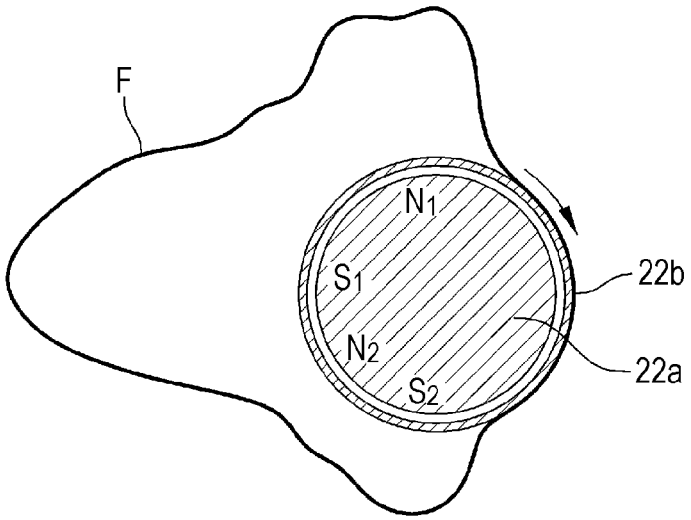

FIGS. 3A and 3B illustrate the magnetic flux density distribution and magnetic attraction distribution, respectively, on the peripheral surface of the sleeve 22*b* of the developing roller 22.

Figure 4:
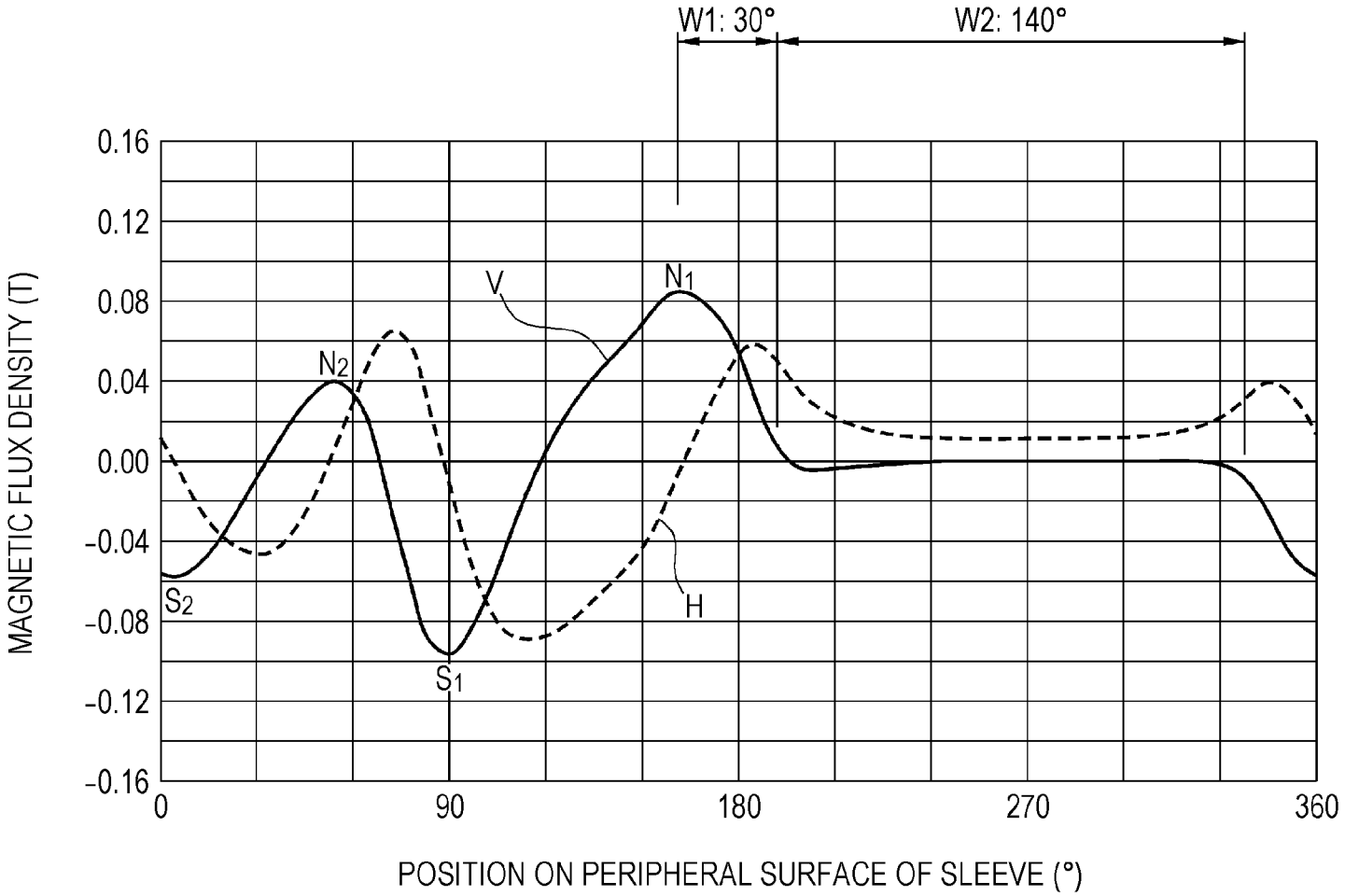
FIG. 4 is a graph of the magnetic flux density distribution on the peripheral surface of the developing roller included in the developing device illustrated in FIG. 2.

In FIG. 3A, the solid lines show the distribution V of magnetic flux density in a direction perpendicular to the peripheral surface of the sleeve 22*b* on the peripheral surface of the sleeve 22*b*. The broken lines show the distribution H of magnetic flux density in a direction along the peripheral surface of the sleeve 22*b*. FIG. 3B shows the distribution F of magnetic attraction in the direction perpendicular to the peripheral surface of the sleeve 22*b* on the peripheral surface of the sleeve 22*b*. FIG. 4 is a graph of the magnetic flux density distribution on the peripheral surface of the sleeve 22*b*, wherein the horizontal axis represents the position in the circumferential direction.

The magnet roller 22*a* of the developing roller 22 includes four magnetic poles that are arranged in the circumferential direction. More specifically, a developing magnetic pole S1 is disposed in a developing region in which the sleeve 22*b* faces the photoconductor drum 1. A first transporting magnetic pole N1 is disposed downstream of the developing magnetic pole S1 in the rotation direction of the sleeve 22*b*. A second transporting magnetic pole N2 is disposed upstream of the developing magnetic pole S1, and an attracting magnetic pole S2, which attracts the developer supplied by the first auger 23, is disposed upstream of the second transporting magnetic pole N2. The interval from the first transporting magnetic pole N1 to the attracting magnetic pole S2 in the rotation direction of the sleeve 22*b* is larger than intervals between the other magnetic poles.

The magnet roller 22*a* that is magnetized as described above is disposed in the sleeve 22*b*. As illustrated in FIGS. 3A and 4, the distribution V of the magnetic flux density in the direction perpendicular to the peripheral surface of the sleeve 22*b* on the peripheral surface of the sleeve 22*b* has peaks at positions near the positions where the magnetic poles are disposed. In the regions between the attracting magnetic pole S2 and the second transporting magnetic pole N2, between the second transporting magnetic pole N2 and the developing magnetic pole S1, and between the developing magnetic pole S1 and the first transporting magnetic pole N1, the magnetic flux density rapidly decreases from the peaks at the magnetic poles, and the polarity is reversed. Then, the magnetic flux density increases toward the adjacent magnetic poles. In the region between the first transporting magnetic pole N1 and the attracting magnetic pole S2, the magnetic flux density rapidly decreases from the peak at the first transporting magnetic pole N1 toward the downstream side, and then the gradient of reduction decreases so as to form a region in which the magnetic flux density is small on the downstream side of the region which the magnetic flux density rapidly decreases. In a region near the attracting magnetic pole S2 at the downstream side, the magnetic polarity is reversed from that at the first transporting magnetic pole N1, and the magnetic flux density rapidly increases to the peak at the attracting magnetic pole S2.

The distribution H of the magnetic flux density in the tangential direction on the peripheral surface of the sleeve 22*b* has peaks between the magnetic poles. The magnetic flux density decreases toward the positions of the magnetic poles, where the magnetic polarity is reversed. In the region between the first transporting magnetic pole N1 and the attracting magnetic pole S2, the magnetic flux density increases from the positions of the magnetic poles toward the midpoint between the magnetic poles to form two peaks, and then decreases to form a region in which the magnetic flux density is small between the peaks.

FIG. 3B shows the distribution of magnetic attraction in the direction perpendicular to the peripheral surface of the sleeve 22*b* of the developing roller 22, which has the above-described magnetic flux density distribution. As shown in FIG. 3B, magnetic attraction that is large enough to hold the developer on the sleeve 22*b* is continuously applied over a region from the position of the attracting magnetic pole S2 to the position of the first transporting magnetic pole N1 through the positions of the second transporting magnetic pole N2 and the developing magnetic pole S1. The magnetic attraction rapidly decreases from the first transporting magnetic pole N1 toward the downstream side in the rotation direction of the sleeve 22*b*, and a region in which the magnetic attraction is reduced so that the developer cannot be held on the peripheral surface of the sleeve 22*b* if the developer receives gravity or both gravity and centrifugal force is formed upstream of the attracting magnetic pole S2. This region substantially coincides with the region between the first transporting magnetic pole N1 and the attracting magnetic pole S2 in which the magnetic flux density in the direction perpendicular to the peripheral surface of the sleeve 22*b* and the gradient thereof are small.

Referring to FIG. 4, the range W1 from the position at which the magnetic flux density in the perpendicular direction is at a peak at the first transporting magnetic pole N1 to the region in which the magnetic attraction is reduced so that the developer cannot be held on the peripheral surface of the sleeve 22*b* is about 30° in terms of the central angle of the developing roller 22. An attraction reduction region W2, which is the region in which the magnetic attraction is reduced so that the developer cannot be held on the peripheral surface of the sleeve 22*b*, extends about 140° in terms of the central angle of the developing roller 22. As illustrated in FIG. 3B, the attraction reduction region W2 in which the developer cannot be held on the peripheral surface of the sleeve 22*b* extends from a region in which the gravity is applied in a direction for pressing the developer against the peripheral surface of the sleeve 22*b* to a region in which the gravity is applied in a direction for separating the developer from the sleeve 22*b* through the position at which the gravity is applied in a tangential direction of the peripheral surface, that is, the position at which the tangential direction of the peripheral surface of the sleeve 22*b* is vertical or substantially vertical.

In the developing device 20, the developer that has been stirred and transported by the first and second augers 23 and 24 is supplied toward the peripheral surface of the developing roller 22, and adheres to the peripheral surface of the sleeve 22*b* in the magnetic field of the attracting magnetic pole S2. Then, the developer is transported by the rotation of the sleeve

22*b* to the developing region, in which the developing magnetic pole S1 faces the photoconductor drum 1, through the position of the second transporting magnetic pole N2. The toner contained in the developer transfers to the latent image on the photoconductor drum 1 in the developing region, so that a toner image is formed on the photoconductor drum 1.

The developer that has passed through the developing region is further transported through the position of the first transporting magnetic pole N1, and enters the attraction reduction region W2, in which the magnetic attraction is reduced so that the developer cannot be held on the sleeve 22*b*, between the first transporting magnetic pole N1 and the attracting magnetic pole S2. In this region, the developer on the sleeve 22*b* receives a centrifugal force, and reaches the region in which the gravity is applied to the developer in the direction for separating the developer from the sleeve 22*b*. Accordingly, the developer is separated from the peripheral surface of the sleeve 22*b* and falls to a region in which the developer is stirred by the first auger 23. Then, the developer is sufficiently stirred and transported by the first and second augers 23 and 24 in the developer chambers 26 and 27, and is then supplied to the sleeve 22*b* again and used in the developing process.

When the developer is separated from the peripheral surface of the sleeve 22*b* as described above, the position at which the developer is separated from the sleeve 22*b* is substantially constant since the magnetic attraction on the peripheral surface of the sleeve 22*b* rapidly decreases.

Figure 5:
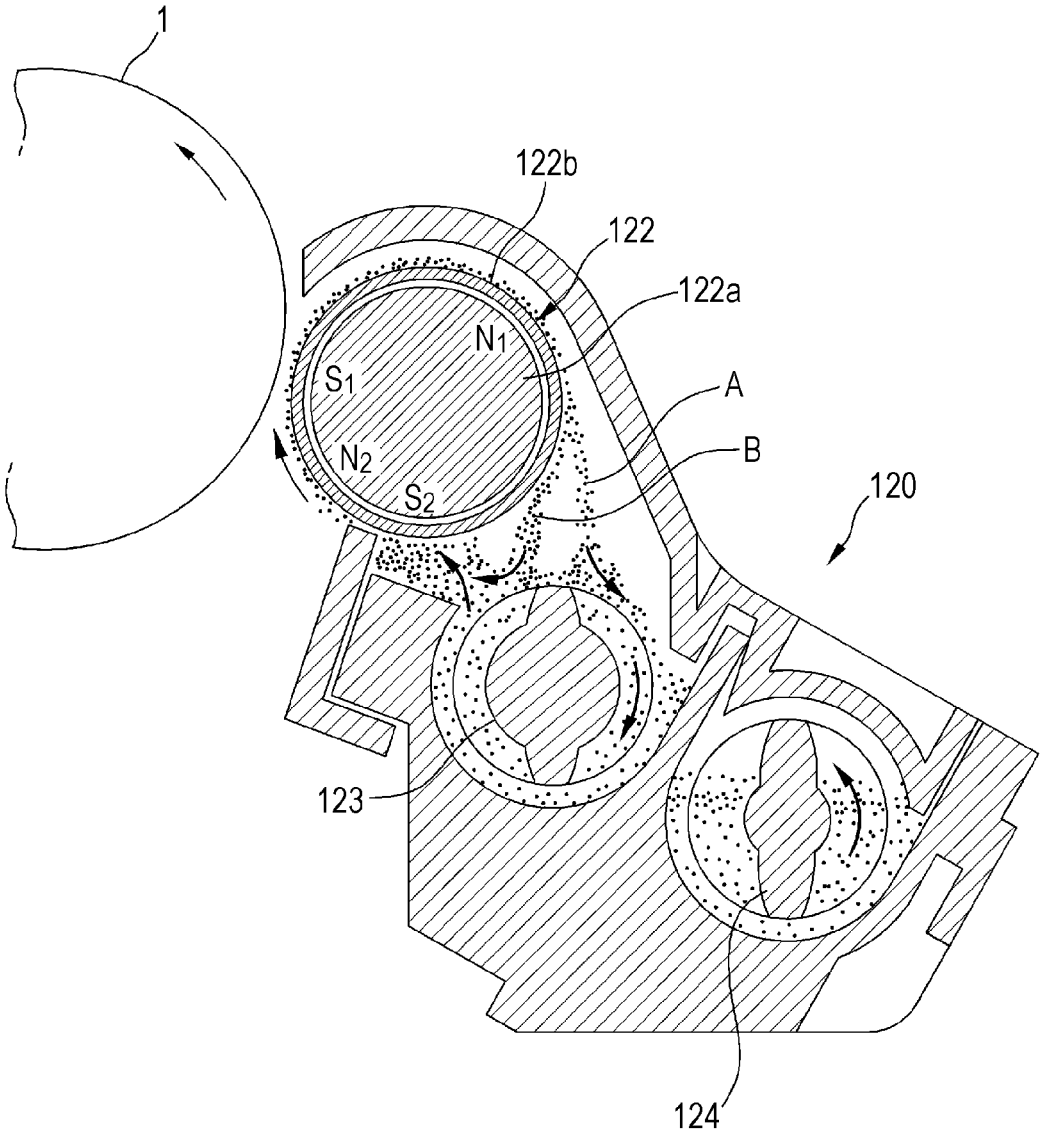
FIG. 5 RELATED ART
FIG. 5 is a schematic sectional view for describing a problem of a developing device according to the related art.

FIG. 5 shows a developing device which does not include the structure according to the exemplary embodiment of the present invention and in which the magnetic attraction gradually decreases. Referring to FIG. 5, when a rotation speed of a sleeve 122*b* is changed to a high speed and a large centrifugal force is applied, the developer is separated from the sleeve 122*b* in an early stage at an upstream position in the rotation direction of the sleeve 122*b*, as shown by A in FIG. 5. When the rotation speed is low and the centrifugal force is small, the developer remains on the sleeve 122*b* until the developer is transported to a downstream position, as shown by B in FIG. 5, and is then separated from the surface of the sleeve 122*b* at a later time. When the developer is separated from the surface of the sleeve 122*b* at a later time, the developer is separated after being transported to a position near the attracting magnetic pole S2 at a downstream position. Therefore, there is a risk that the developer that has been separated will be supplied to the sleeve 122*b* again before being sufficiently stirred by augers 123 and 124. When the developer is not sufficiently stirred by the augers 123 and 124, the concentration of the toner in the developer decreases, and a toner image with non-uniform density will be formed.

In the developing device according to the exemplary embodiment of the present invention, the occurrence of the above-described problem may be reduced since the magnetic attraction rapidly decreases in the region between the first transporting magnetic pole N1 and the attracting magnetic pole S2.

In addition, in the region in which the developer is separated from the sleeve 22*b*, the gravity is applied to the developer in a direction for separating the developer from the peripheral surface of the sleeve. Therefore, the developer is separated by the resultant of the gravity and the centrifugal force, so that the influence of the centrifugal force is reduced and variation in the position at which the developer is separated may be reduced accordingly.

The rotation speed of the sleeve 22*b* is changed when, for example, the process speed, that is, the driving speed of the photoconductor drum 1, the developing roller 22, the intermediate transfer belt 11, the fixing device 7, etc., in the image forming operation, is changed in accordance with the type, thickness, etc., of the recording sheet onto which the toner image is transferred.

In the above-described developing device 20, the developer is separated from the peripheral surface of the sleeve 22*b* in a region between the magnetic poles having the opposite polarities. Therefore, compared to the case in which the developer is separated in a region between magnetic poles having the same polarity, accumulation of the developer is suppressed. Accordingly, the occurrence of image defects due to accumulation of the developer may be reduced, as described below.

Figure 6A:
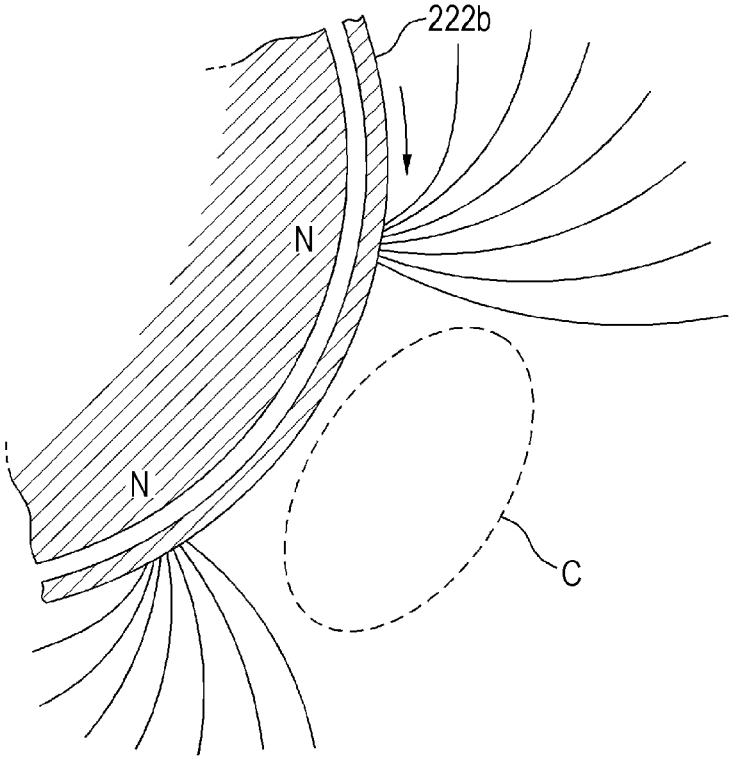
FIG. 6A RELATED ART
FIGS. 6A and 6B are enlarged sectional views for describing a problem of a developing device according to the related art.
Figure 6B:
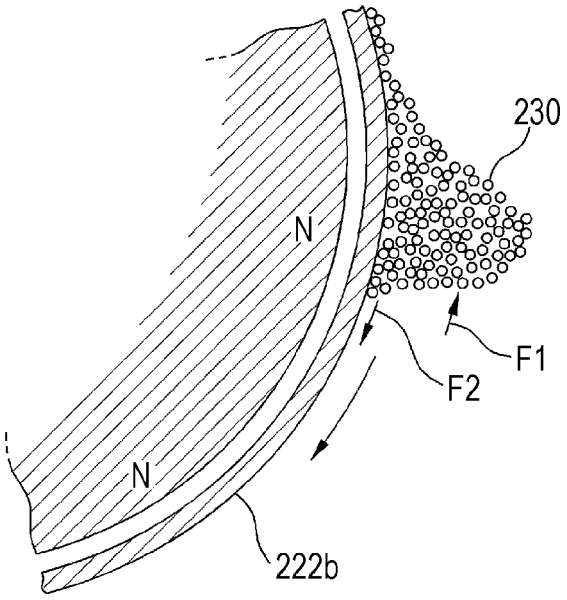
FIG. 6B RELATED ART

FIG. 6A shows the case in which two magnetic poles having the same polarity are arranged next to each other and developer is separated from a surface of a sleeve 222*b* by a repulsive magnetic field formed between the magnetic poles. In this case, as shown by the magnetic lines of force in FIG. 6A, a repulsive magnetic field is formed between the two magnetic poles, so that a region C in which magnetic particles contained in the developing device cannot be easily placed is generated. When the developer that has been held on and transported by the sleeve 222*b* reaches the above-described region C, the developer is separated from the surface of the sleeve 222*b* and returned to a developer chamber. However, immediately before reaching the region C, the magnetic particles receive a force that tries to stop the movement in the transport direction from the repulsive magnetic field. Therefore, as illustrated in FIG. 6B, the developer 230 accumulates in a region immediately in front of the above-described region where the repulsive magnetic field is formed, and the amount of the developer 230 that accumulates increases as the developer 230 is continuously transported by the sleeve 222*b*. The developer 230 that has accumulated receives a force F1 applied by the repulsive magnetic field to stop the movement of the developer 230 and a force F2 that tries to transport the developer 230 in the rotation direction of the sleeve 222*b* by the friction between the developer 230 and the peripheral surface of the sleeve 222*b*. When the amount of the developer 230 that has accumulated increases, the developer 230 is suddenly scattered and separated from the surface of the sleeve 222*b*. When the amount of the developer 230 that accumulates on the surface of the sleeve 222*b* suddenly changes in this manner, the frictional force applied between the developer 230 and the surface of the sleeve 222*b* also suddenly changes. Accordingly, the driving load of the sleeve 222*b* varies. When the driving load varies, the rotation speed of the sleeve 222*b* also varies, and an image with non-uniform density may be formed.

In contrast, in a developing device in which the developer is separated from the sleeve in a region between magnetic poles having the opposite polarities, the above-described accumulation of the developer does not occur. Thus, the developer does not easily accumulate and image defects due to non-uniform rotation of the sleeve may be suppressed.

In the case where a toner that generates a small frictional force between itself and the peripheral surface of the sleeve, such as a toner formed by a polymerization method, is used, a large amount of developer accumulates in the region immediately in front of the region where the repulsive magnetic field is formed. When a force that tries to stop the movement of the developer is applied by the repulsive magnetic field, the developer easily slides along the surface of the sleeve, so that a large amount of developer accumulates. When a large amount of developer accumulates in this manner, an image with non-uniform density is easily formed. However, the occurrence of the problem that occurs when, in particular, the toner formed by a polymerization method is used may be effectively reduced by separating the developer from the sleeve in a region between the magnetic poles having the opposite polarities.

In the developing device 20 according to the exemplary embodiment of the present invention, W1 is the central angle from the position where the first transporting magnetic pole N1 is disposed to the attraction reduction region W2 in the rotation direction of the sleeve 22*b*. An experiment is performed to study the relationship between the central angle W1 and the displacement of the position at which the separated developer falls. The result of the experiment will now be described.

The position where the first transporting magnetic pole N1 is disposed is the center of the first transporting magnetic pole N1, where the magnetic flux density in the direction perpendicular to the surface of the sleeve 22*b* has a peak. The attraction reduction region W2 is the region in which the magnetic attraction is reduced so that the developer cannot be held on the peripheral surface of the sleeve 22*b*. When the attraction reduction region W2 faces downward, the developer on the sleeve 22*b* falls by gravity and cannot be held on the sleeve 22*b*.

Plural magnet rollers are manufactured, each magnet roller having a different central angle W1 of the sleeve 22*b* from the position where the first transporting magnetic pole N1 is disposed to the attraction reduction region W2 in the rotation direction of the sleeve 22*b* depending on the state of magnetization of the first transporting magnetic pole N1. The sleeve 22*b* is rotated in the developing device 20 according to the above-described exemplary embodiment. The position at which the developer falls when the developer is supplied to the sleeve 22*b* and then separated from the sleeve 22*b* is studied. The rotation speed of the sleeve 22*b* is set to the maximum speed at which the developing device 20 may be used and to ⅓ of the maximum speed. The difference between the positions at which the developer falls when the rotation speed is set to the above-mentioned speeds is measured.

The position at which the developer falls is defined as the highest position on the outer periphery of the first auger 23.

Figure 7:
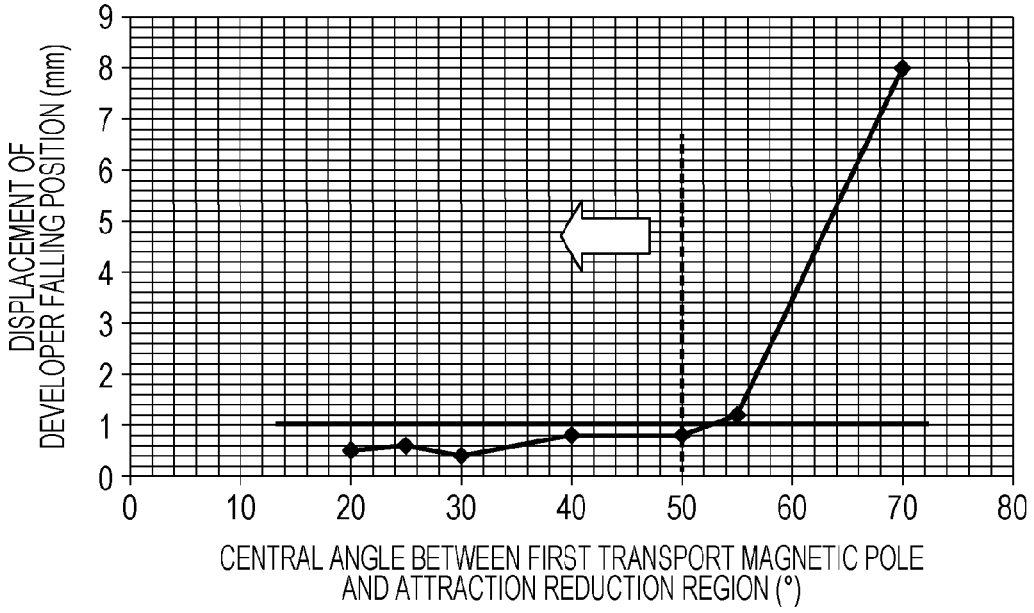
FIG. 7 is a graph showing the relationship between the central angle between a first transporting magnetic pole and an attraction reduction region and a displacement of a developer falling position.

As is clear from FIG. 7, which shows the result of the experiment, the displacement of the position at which the developer falls caused when the rotation speed of the sleeve 22*b* is changed is as small as 1 mm or less when the central angle W1 from the position where the first transporting magnetic pole N1 is disposed to the attraction reduction region W2 is in the range from 20° to 50° or approximately 50°. The displacement suddenly increases when the central angle W1 is in the range of 50° to 60°.

The falling position and the displacement thereof may vary depending on the diameter and rotation speed of the sleeve, the developer that is used, and other factors. However, even when these factors vary, a similar tendency is expected as long as they are within common parameter ranges used in a developing device that performs a developing process by using a magnetic developer.

An experiment is also performed to study the relationship between the size of the attraction reduction region W2 and the influence of the attracting magnetic pole S2 at the downstream position on the developer that has been separated.

In this experiment, plural magnet rollers which each have the attraction reduction region W2 of a different size between the first transporting magnetic pole N1 and the attracting magnetic pole S2 are manufactured by changing the positions of the first transporting magnetic pole N1 and the attracting magnetic pole S2. The magnet rollers are installed in the developing device 20 according to the exemplary embodiment and a test image is repeatedly developed. The rotation speed of the sleeve 22*b* is set to a minimum speed at which the developing device 20 may be used.

Figure 8A:
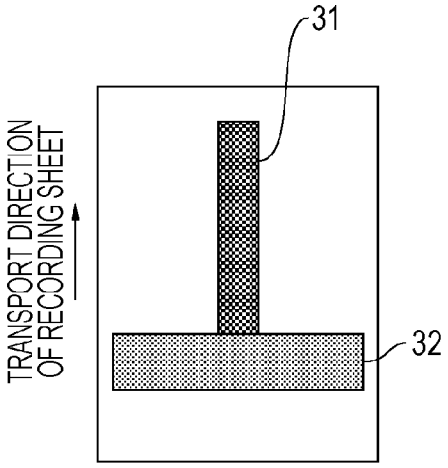
FIGS. 8A and 8B illustrate test images used in an experiment.
Figure 8B:
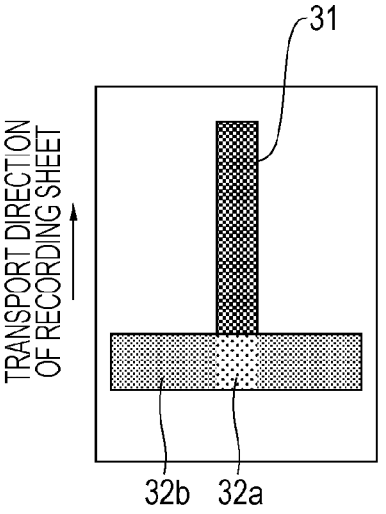

As illustrated in FIG. 8A, a front portion of the test image to be developed in the direction in which the image is formed, that is, in the direction in which the recording sheet is transported, is a long band-shaped image 31 that extends in the transport direction, and a back portion of the test image is a halftone image 32 that is wider than the band-shaped image 31. The halftone image 32 has a coverage rate of 30%; that is, the percentage of the area in which the toner is transferred is 30%. If there is a difference in density between a part 32*a* of the halftone image 32 that is behind the band-shaped image 31 and a part 32*b* of the halftone image 32 in a region where the band-shaped image 31 is not provided, as illustrated in FIG. 8B, the densities are compared with each other.

Figure 9:
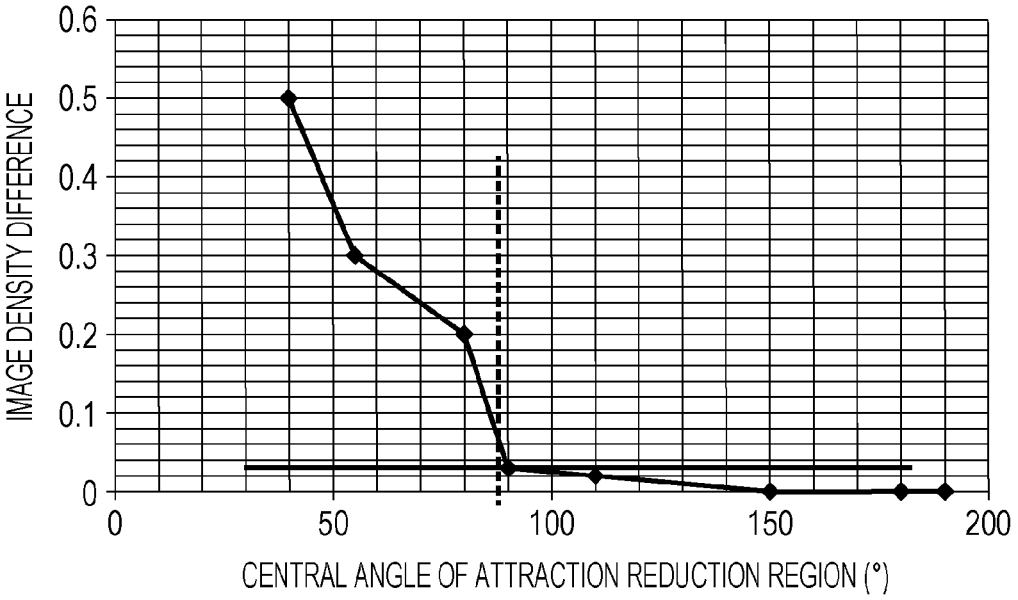
FIG. 9 is a graph showing the relationship between the central angle of the attraction reduction region and the difference in image density.

As is clear from FIG. 9, which shows the result of the above-described experiment, the difference in density between the part behind the band-shaped image and the part in the region where the band-shaped image is not provided is zero or extremely small when the size of the attraction reduction region W2 in terms of the central angle of the sleeve 22*b* is 90° or more or approximately 90° or more. The difference in density considerably increases when the size of the attraction reduction region W2 in terms of the central angle of the sleeve 22*b* is less than 90°. When the size of the attraction reduction region W2 is less than 90°, the developer that has been separated from the sleeve 22*b* is affected by the attracting magnetic pole S2 at the downstream position and is supplied to the sleeve 22*b* before being moved to the region in which the developer is stirred by the first auger 23.

Although the difference in density may vary depending on the arrangements of the developing roller, the augers, etc., in the developing device, a similar tendency is expected even when these factors vary.

The magnetic attraction distribution and the magnetic flux density distribution of the developing roller 22 described in the above-described exemplary embodiment are merely an example, and the developing roller 22 may have other types of distributions within the scope of the present invention.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a sleeve arranged so as to face an image carrier on which an electrostatic latent image is formed, the sleeve having a cylindrical shape and being rotated in a circumferential direction, the image carrier facing only one sleeve, which is the sleeve; and a magnet roller supported in a fixed state in the sleeve, the magnet roller having a plurality of magnetic poles arranged in the circumferential direction and magnetically attracting developer containing a magnetic material so that the developer is held on a peripheral surface of the sleeve, the magnetic poles including a first magnetic pole and a second magnetic pole that is disposed adjacent to the first magnetic pole and downstream of the first magnetic pole in a rotation direction of the sleeve and that has a polarity opposite to a polarity of the first magnetic pole, wherein a distribution of magnetic attraction applied to the developer on the peripheral surface of the sleeve in a region from the first magnetic pole to the second magnetic pole of the magnet roller is such that the magnetic attraction decreases from a position where the first magnetic pole is disposed toward the downstream side in the circumferential direction, a gradient of change in the magnetic attraction decreases in a region downstream of a region in which a gradient of reduction in the magnetic attraction temporarily increases, thereby forming an attraction reduction region in which the magnetic attraction is reduced so that the developer cannot be held on the peripheral surface of the sleeve, and the gradient of change in the magnetic attraction increases in a region downstream of the attraction reduction region so that the magnetic attraction increases to a position where the second magnetic pole is provided.

2. The developing device according to claim 1, wherein a central angle of the sleeve from the position where the first magnetic pole is disposed to the attraction reduction region is 50° or less.

3. The developing device according to claim 1, wherein the attraction reduction region extends 90° or more in terms of a central angle of the sleeve.

4. The developing device according to claim 1, wherein the attraction reduction region extends through a position where a tangent line of the peripheral surface of the sleeve is vertical.

5. The developing device according to claim 1, wherein the number of the plurality of magnetic poles arranged in the magnet roller is an even number of four or more, and a central angle between the positions where the first and second magnetic poles are disposed on both sides of the attraction reduction region is larger than central angles between the other magnetic poles.

6. The developing device according to claim 1, wherein the developer, which is supplied from a developer container that contains the developer to the peripheral surface of the sleeve, is a two-component developer containing toner formed by a polymerization method and magnetic carrier.

7. An image forming apparatus comprising:

an image carrier having an endless peripheral surface on which an electrostatic latent image is formed;

developing device according to claim 1 that develops the electrostatic latent image by transferring toner to the electrostatic latent image;

a transfer unit that transfers a toner image onto a recording medium, the toner image being formed on the image carrier by developing the electrostatic latent image; and a fixing unit that fixes the toner image transferred onto the recording medium to the recording medium.

* * * * *